US005694824A

United States Patent [19]

Jacko et al.

[11] Patent Number: 5,694,824

[45] Date of Patent: Dec. 9, 1997

[54] CUTTING HEAD FOR SLICING A FOOD PRODUCT

[75] Inventors: Michael S. Jacko, Chesterton; Eugene H. Cole, Valparaiso, both of Ind.

[73] Assignee: Urschel Laboratories Incorporated, Valparaiso, Ind.

[21] Appl. No.: 229,313

[22] Filed: Apr. 18, 1994

[51] Int. Cl.[6] ..... B26D 7/26

[52] U.S. Cl. ..... 83/403; 83/698.41; 83/699.51; 83/858; 83/932

[58] Field of Search ..... 83/403, 932, 698.41, 83/698.51, 698.61, 699.51, 699.61, 858; 241/84, 85, 242, 285.1, 285.2; 30/280, 281, 339, 344

[56] References Cited

U.S. PATENT DOCUMENTS

| | | | |
|---|---|---|---|
| 2,195,879 | 4/1940 | Urschel et al. . | |
| 2,436,410 | 2/1948 | Urschel et al. . | |
| 2,599,439 | 6/1952 | Drake | 30/339 X |
| 2,961,024 | 11/1960 | Urschel et al. . | |
| 3,139,127 | 6/1964 | Urschel et al. . | |
| 3,139,128 | 6/1964 | Urschel et al. . | |
| 3,139,129 | 6/1964 | Urschel et al. . | |
| 3,139,130 | 6/1964 | Urschel et al. . | |
| 3,196,916 | 7/1965 | Urschel et al. . | |
| 3,255,646 | 6/1966 | Urschel et al. . | |
| 3,320,905 | 5/1967 | Urschel . | |
| 3,395,742 | 8/1968 | Sanders . | |
| 3,673,907 | 7/1972 | Watanabe | 83/698.61 X |
| 3,889,368 | 6/1975 | Himeno | 30/339 X |
| 3,989,196 | 11/1976 | Urschel . | |
| 4,391,172 | 7/1983 | Galland et al. | 83/403 |
| 4,408,394 | 10/1983 | Phelps | 30/339 X |
| 4,470,327 | 9/1984 | Gerber, Jr. et al. | 30/344 X |
| 4,523,503 | 6/1985 | Julian et al. | 83/403 |
| 4,584,919 | 4/1986 | Bittner | 83/663 |
| 4,588,135 | 5/1986 | Himi | 241/84 |
| 4,604,925 | 8/1986 | Wisdom | 83/13 |
| 4,972,888 | 11/1990 | Dean | 241/95 X |
| 5,095,875 | 3/1992 | Morris et al. | 83/856 |

*Primary Examiner*—Maurina T. Rachuba
*Attorney, Agent, or Firm*—Bacon & Thomas

[57] ABSTRACT

An improved cutting head for slicing a food product is disclosed wherein the cutting head includes a lower mounting ring attached to the bottom of the cutter support segments to position the cutter support segments and which lower mounting ring rests on and is supported by the cutting head support ring. The cutting head also includes an adjustment mechanism to adjust the width of the slicing opening, the mechanism having an adjustment member which is configured to engage a pin attached to a cutter support segment and to contact an adjusting surface on the upper mounting ring so as to space the pin a predetermined distance from the adjusting surface. The cutting head also includes a system for removably attaching the cutting blade to the cutter support segment such that the blade may be readily removed and replaced without completely removing the clamping member from the cutter support segment.

15 Claims, 8 Drawing Sheets

CUTTING HEAD FOR SLICING A FOOD PRODUCT

BACKGROUND OF THE INVENTION

The present invention relates to a cutting head for slicing a food product, more particularly such a cutting head having an improved mounting structure, an improved adjustment mechanism and improved blade attachment features.

Machines for cutting food products such as potatoes, beets, and the like into slices are well known in the art. Typically, such apparatus comprises a stationary annular cutting head having one or more slicing knives mounted thereon which surrounds a rotatable impeller having blades to direct a food product outwardly against the cutting blades as the impeller rotates. The apparatus typically comprises a motor which rotates the impeller, a feed hopper to feed the food product into the impeller as it rotates and some means to collect the sliced food product.

The known apparatus has a cutting head support ring stationarily mounted to the apparatus on which the cutting head is supported. The known cutting heads comprise a plurality of cutter support segments having upper portions attached to a mounting ring and each of which has pins or the like extending from the bottom. The pins typically engage holes formed in the cutting head support ring to properly locate the cutting head support segments. However, it has been discovered that, due to the necessity to often change the cutting heads on a specific machine, the holes and pins become worn and deformed, and are incapable of properly locating and positioning the cutting head support segments, which results in improperly sliced food products.

A cutting blade is attached to each of the cutter support segments via a clamping member attached to the segment by bolts or screws. The cutting blades are disposable and must be replaced to maintain the cutting efficiency of the cutting head and the quality of the sliced food product. Such replacement entails the removal of the clamp member from the cutter support segments, removing the old cutting blade, attaching a new cutting blade and reattaching the clamping member. Such a blade replacement procedure is time consuming and thereby reduces production efficiency.

The known apparatus has a mechanism to adjust the position of the cutter support segments to adjust the thickness of the sliced food product. The blade adjustment mechanism of the known slicing devices has also been discovered to be excessively time consuming. Typically, such adjustment mechanism comprises an adjusting pin extending from each cutter support segment, an upper portion of the adjustment pin engaging a groove in a threaded adjusting member. The adjusting member is threaded into the mounting ring such that by rotating the adjusting member, the position of the cutter support segment may be adjusted relative to the cutting head support ring and the mounting ring so as to properly adjust the width of the cutting opening and, consequently, adjust the thickness of the sliced food product. A locking bolt extends through the mounting ring and engages the cutter support segment to lock it in its adjusted position. Again, the adjustment procedure has been found to be unduly time consuming and, in order to decrease this adjustment time, such adjustments are often carried out without properly unlocking the locking bolt, thereby causing damage to the cutter support segments and the mounting ring.

SUMMARY OF THE INVENTION

An improved cutting head for slicing a food product is disclosed wherein the cutting head includes a lower mounting ring attached to the bottom of the cutter support segments for positioning the cutter support segments, which lower mounting ring rests on and is supported by the cutting head support ring. The cutting head also includes an adjustment mechanism to adjust the width of the slicing opening, the mechanism having an adjustment member which is configured to engage a pin attached to a cutter support segment and to contact an adjusting surface on the upper mounting ring so as to space the pin a predetermined distance from the adjusting surface. The adjusting member may define a hole configured to accept a portion of the pin and may also define one or more positioning surfaces each spaced a predetermined distance from the center of the hole. By merely placing the adjusting member such that the pin engages the hole and the positioning surface contacts the adjusting surface of the mounting ring, the desired slice thickness may be achieved.

The cutting head also includes a system for removably attaching the cutting blade to the cutter support segment such that the blade may be readily removed and replaced without completely removing the clamping member from the cutter support segment. The blade defines one or more notches which engage pins extending from the cutter support segment. Thus, by merely loosening the clamping member, a handle portion formed on the blade and extending through the upper mounting ring may be grasped by the user and the cutting blade may be pulled upwardly through the mounting ring. Similarly, a new blade may be readily attached by inserting it downwardly through the mounting ring such that the notches engage the pins and subsequently tightening the clamping member. The cutting blade has a handle portion extending from one side of a body portion, such that, when the cutting blade is attached to the cutter support segment in its clamped position, the handle portion extends upwardly through the mounting ring so as to facilitate grasping by the user.

These features markedly increase the efficiency of using such a cutting head insofar as it eliminates the possibility of damage to the holes in the cutting head support ring by incorporating a lower mounting ring. The adjustment procedure is also rendered less time consuming by employing an adjustment member having fixed distances between a positioning surface and the center of a hole which engages an adjustment pin. Finally, the blade replacement is rendered less time consuming by a blade configuration which facilitates the removal and replacement of the blade without the necessity of completely removing the clamping member.

DETAILED DESCRIPTION OF THE PREFERRED EMBODIMENTS

Figure 1:
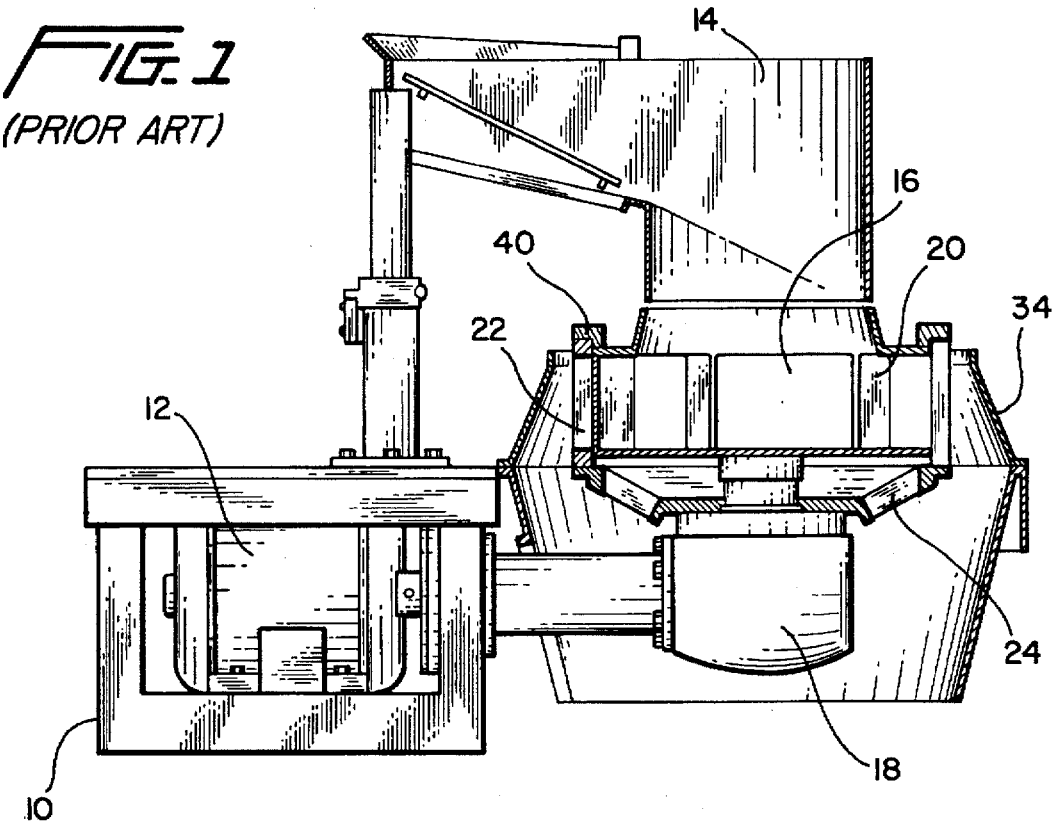
FIG. 1 (PRIOR ART)
FIG. 1 is a side view of a known slicing apparatus having a known cutting head configuration.

A known slicing machine is illustrated in FIG. 1 and comprises a main frame 10 on which is mounted a drive motor 12 and a food product hopper 14. Motor 12 rotates impeller 16 via gear box 18 such that food products dropping onto the impeller 16 through the hopper 14 will be directed radially outwardly via centrifugal forces and caused to rotate by contact with the impeller blades 20. Stationary cutting head 22 is attached to cutting head support ring 24 which is, in turn, fixedly attached to the housing for gear box 18.

Figure 2:
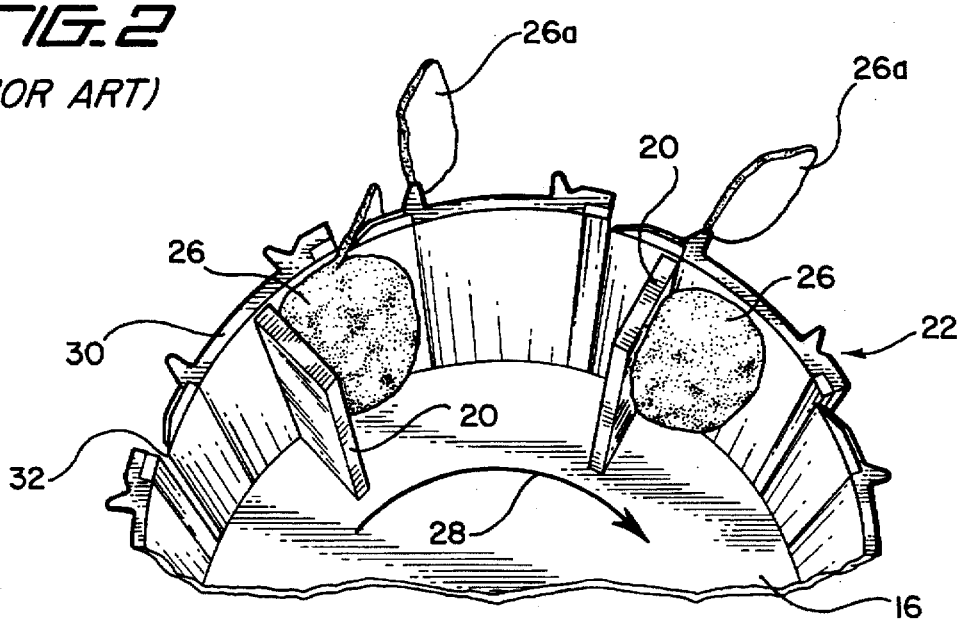
FIG. 2 (PRIOR ART)
FIG. 2 is a partial, perspective view illustrating the known slicing of a food product.

As illustrated in FIG. 2, rotation of impeller 16 urges the food product pieces 26 around the interior of the cutting head 22 in the direction of arrow 28. The cutting head 22 comprises a plurality of cutter head support segments 30, each having a cutting blade 32 mounted thereon. The cutting blades 32 are positioned such that they extend radially inwardly a slight distance from the adjacent portion of the adjacent cutting support segment such that movement of the food product 26 in the direction of arrow 28 causes slices 26*a* to be cut from the food product. Chute 34, which surrounds the cutting head 22 directs the food product slices downwardly into a receiving container (not shown).

Figure 3:
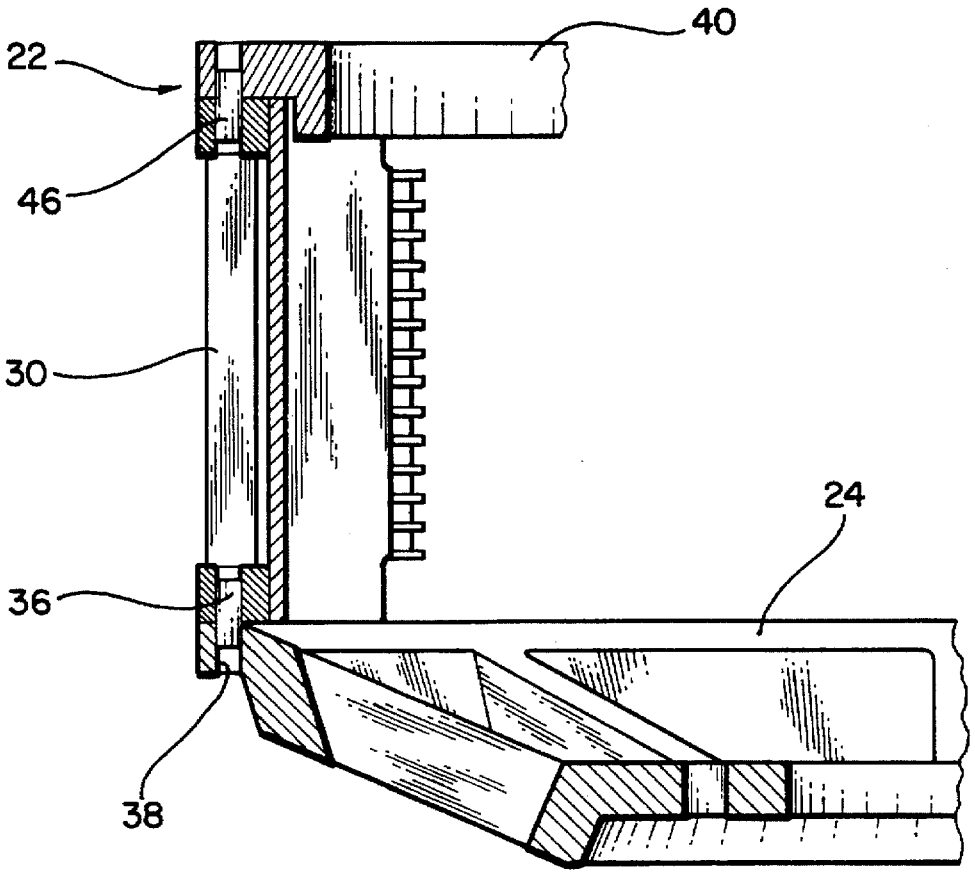
FIG. 3 (PRIOR ART)
FIG. 3 is a partial, cross-sectional view of a known cutting head mounted on a cutting head support ring.

As best illustrated in FIG. 3, the known cutting head 22 is attached to the cutting head support ring 24 by pins 36 which extend downwardly from the bottom of each of the cutter support segments 30 and engage holes 38 formed adjacent to the periphery of the cutting head support ring 24. As noted previously, it is quite often necessary to change cutting heads on a given machine which must be accomplished with a minimal amount of down time. The repetitious changing of cutting heads eventually causes elongation of the locating holes 38, or deformation of the pins 36, thereby rendering proper positioning of the cutter support segments impossible. If the cutter support segment pins are not properly positioned by the locating holes in the cutting head support ring, it will not properly slice the food product, thereby resulting in large amounts of wasted food product.

Figure 4:
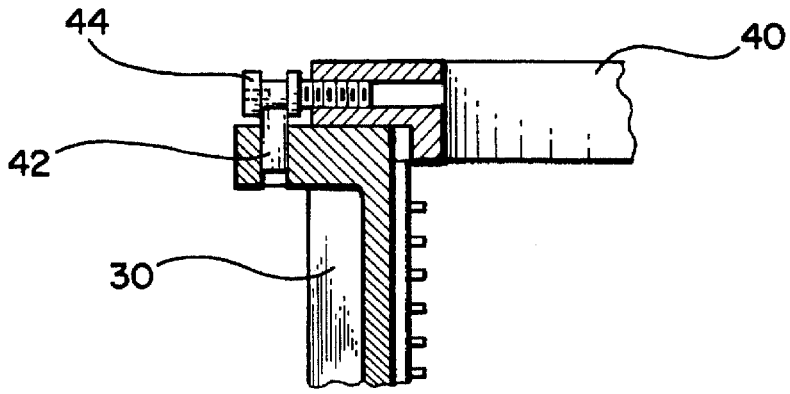
FIG. 4 (PRIOR ART)
FIG. 4 is a partial, cross-sectional view of the known cutting head incorporating a known adjustment mechanism.

The known cutter support segment adjusting mechanism is illustrated in FIG. 4. In order to properly position the cutting blade 32 so as to cut the desired thickness of food product slice, it is necessary to adjust the position of the cutter support segments relative to the mounting ring 40. The cutting blade, along with a rear edge portion of an adjacent cutter support segment define a food slicing opening, the dimension of this opening determining the thickness of the food slice. In the past, this adjustment has been accomplished by an adjusting pin 42 attached to each cutter support segment 30 such that a portion of the pin extends upwardly therefrom. An adjusting screw 44 is threaded into an opening in the upper mounting ring 40, the adjusting screw defining a groove into which extends the upper portion of the adjusting pin 42. As can be seen, by threading the adjusting member 44 into or out of the mounting ring 40, the adjusting pin 42 will move in a generally radial direction with respect to the upper mounting ring 40, thereby causing the cutter support segment 30 to pivot about pin 36, which extends into the cutting head support ring 24 and coaxial pin 46 which extends into an opening in the upper mounting ring 40 (see FIG. 3). A locking bolt (not shown) may extend downwardly through the upper mounting ring 40 such that it bears against an upper surface of the cutter support segment 30 to frictionally lock the segment in position once it has been adjusted.

Figure 5:
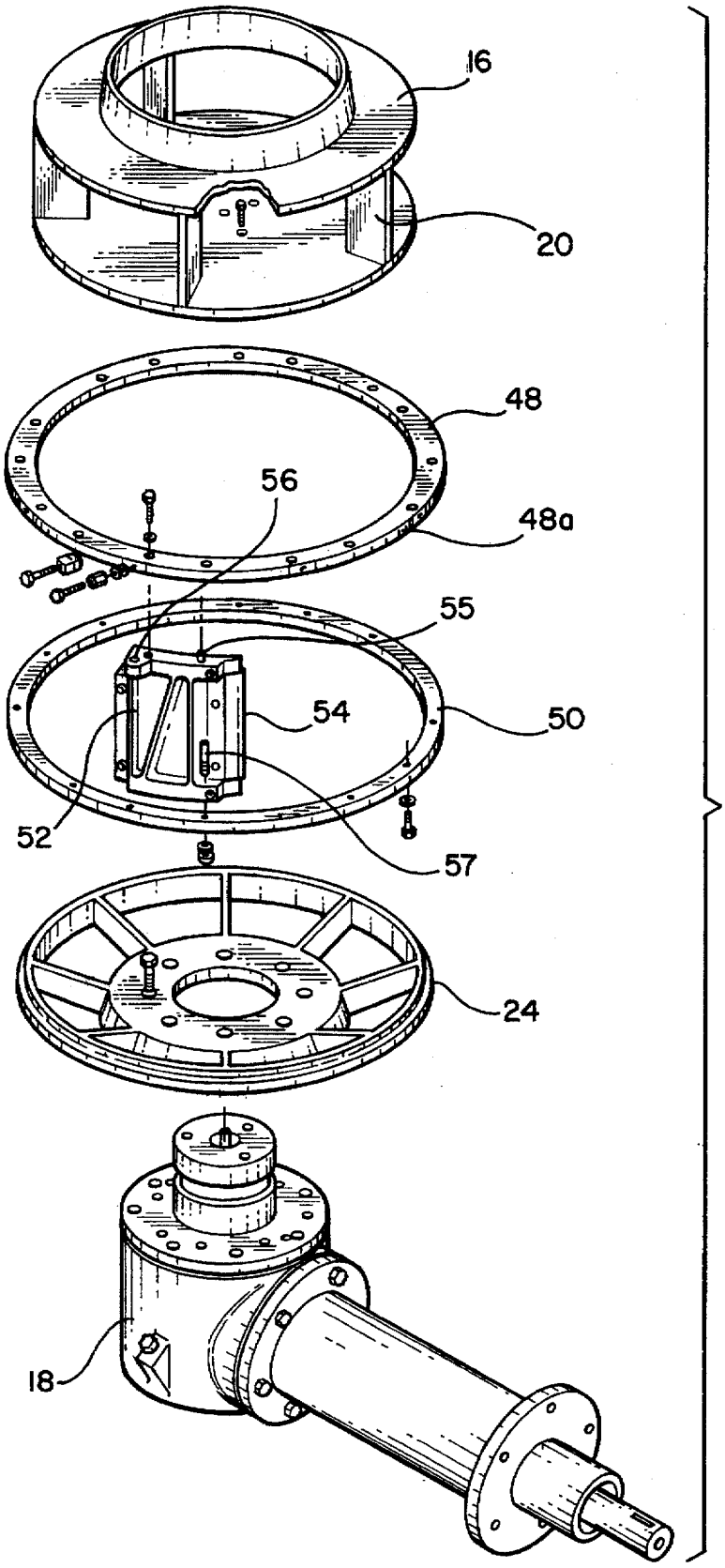
FIG. 5 is an exploded perspective view of the cutting head according to the present invention, the cutting head support ring and the rotatable impeller.

The cutting head according to the present invention is illustrated in FIG. 5. In this Figure, the gear box 18 and the impeller 16 are also shown, as is cutting head support ring 24. As in the known device, cutting head support ring 24 is fixedly attached to the gear box casing 18, while impeller 16 is rotatably driven by an output shaft from the gear box 18. The cutting head according to the present invention comprises an upper annular mounting ring 48, a lower annular mounting ring 50 between which are mounted a plurality of cutter support segments 52, each having a cutting blade 54 mounted thereon. As can be seen, each cutter support segment has a top portion which is pivotally attached to the upper mounting ring 48 via an upwardly extending pin 55, a bottom which is pivotally attached to the lower mounting ring 50 via pin 57, a forward edge portion to which the cutting blade 54 is attached and a rear edge portion facing in an opposite direction from the forward edge portion. Annular mounting ring 48 has an outer peripheral adjusting surface 48*a* formed thereon.

Figure 6:
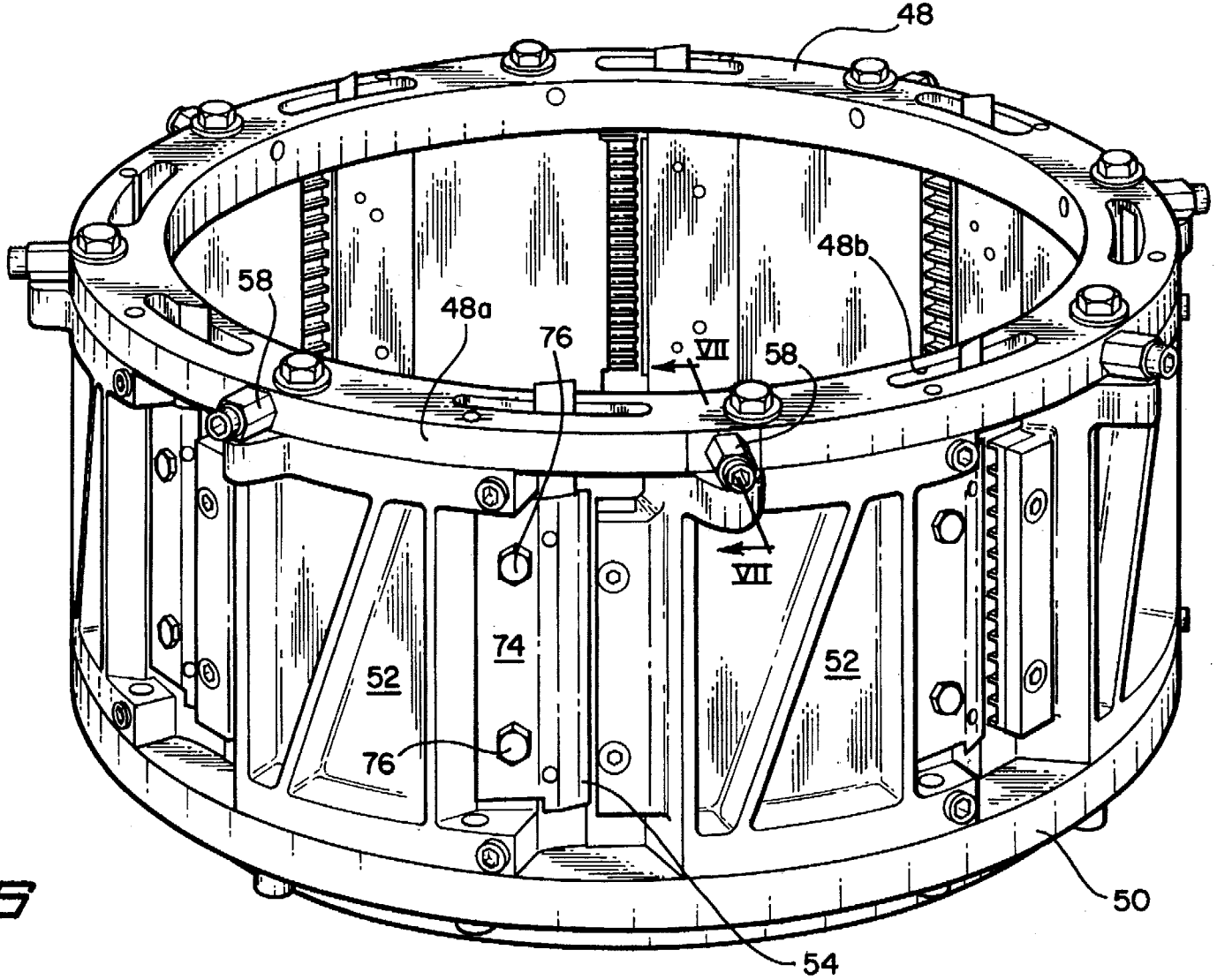
FIG. 6 is a perspective view of the cutting head according to the present invention.
Figure 7:
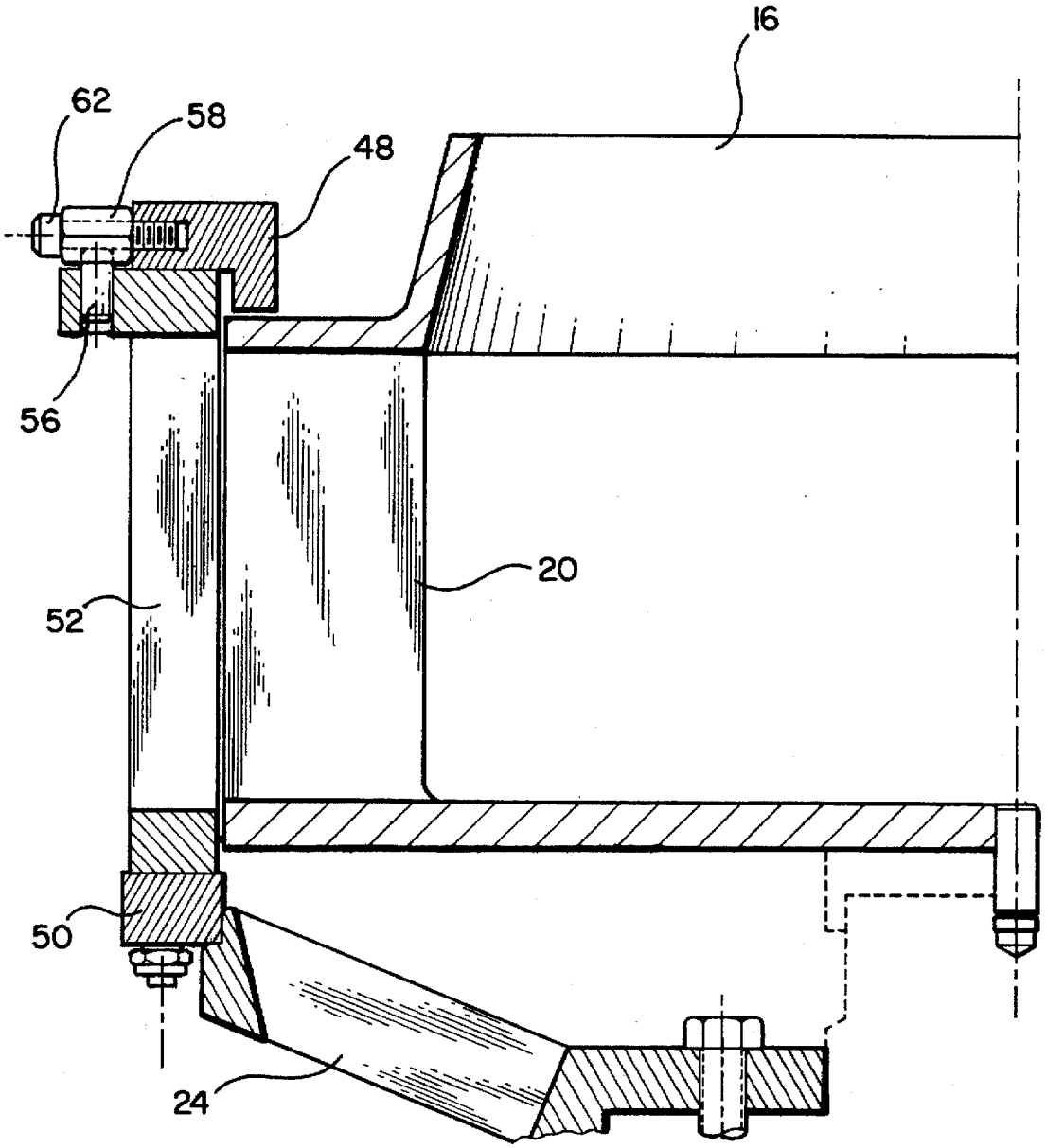
FIG. 7 is a partial, cross-sectional view taken along line VII—VII in FIG. 6.

The assembled cutting head is illustrated in FIG. 6 and, as can be seen, a plurality of cutter support segments 52 are arranged in a generally circular array, and are attached to both upper mounting ring 48 and lower mounting ring 50. Lower mounting ring 50 is supported on cutting head support ring 24 such that the cutting head is stationarily mounted and does not move with respect to the cutting head support ring 24. This can be achieved by frictional forces between the cutting head and the cutting head support ring, or known fastening devices, such as bolts, screws, clamps, or the like may be utilized to removably mount the cutting head on the cutting head support ring 24. As in the known apparatus, rotation of the impeller 16 within the cutting head will cause food products to be sliced as illustrated in FIG. 2.

Figure 8:
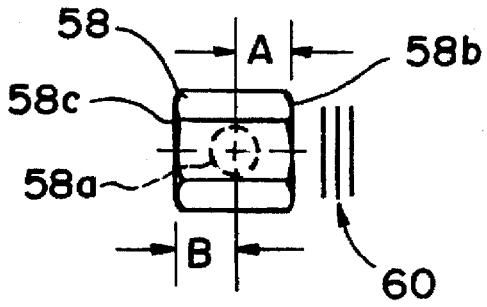
FIG. 8 is a side view of a first embodiment of the adjustment member according to the present invention.

The adjustment means for adjusting the positions of the cutter support segments 52 so as to adjust the thickness of the food product, comprises adjusting surface 48*a* formed on the outer periphery of upper mounting ring 48, an adjustment pin 56 attached to an upper portion of the cutter support segments 52 such that a portion of the pin extends beyond the cutter support segment and an adjustment member 58 defining an opening 58*a* configured to receive a portion of the adjustment pin 56. The adjustment member 58 also defines a positioning surface 58*b* which contacts the adjusting surface 48*a* so as to position the center line of the hole 58*a* a predetermined specific distance from the adjusting surface 48*a*. Should additional adjustment be needed, shims 60 may be interposed between the positioning surface 58*b* and the adjusting surface 48*a*, as illustrated in FIG. 8.

The adjustment member 58 may be formed with a single positioning surface 58*b*, or the opposite facing surface 58*c* may also be utilized as a positioning surface. Hole 58*a* may be formed such that the distance between its center line and positioning surface 58*b*, dimension A as illustrated in FIG. 8, is different from dimension B, the distance between the hole center line and the second positioning surface 58*c*. This enables differing adjustments to be made to the cutter support segment merely by reversing the position of the adjustment member 58. If the adjustment member 58 is formed so as to have two, oppositely facing positioning surfaces, each surface must be countersunk to prevent the head of the attaching bolt 62 from marring the positioning surfaces.

Figure 9:
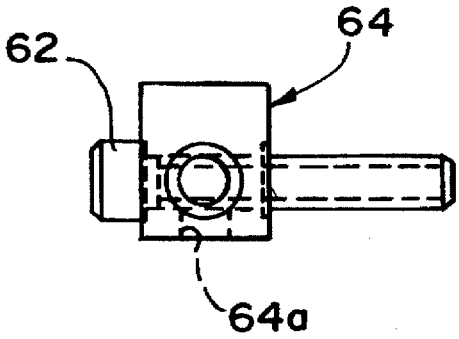
FIG. 9 is a side view of a second embodiment of the adjustment member according to the present invention.
Figure 10:
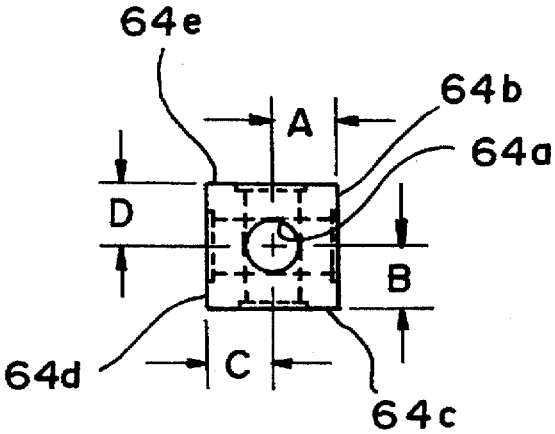
FIG. 10 is a bottom view of the adjustment member illustrated in FIG. 9.

An alternative form of the adjustment member is illustrated in FIGS. 9 and 10. In this embodiment, the adjustment member 64 again defines hole 64*a* which is configured to receive the extending end of the adjustment pin 56. Adjustment member 64 is generally in the configuration of a cube or a parallelepiped with the location of the hole 64*a* being such that the distances between the center line of the hole 64*a* and the sides, dimensions A, B, C, and D illustrated in FIG. 10, are all different from each other. This enables a single adjustment member 64 to be utilized to achieve four or more different, pre-set adjustments of the cutter support segments. The positions of the cutter support segments may be readily changed merely by removing attaching screw or bolt 62, repositioning adjustment member 64 and reinserting the bolt 62. The positioning surfaces are illustrated at 64*b*–64*e* in FIG. 10. Quite obviously, other configurations of adjustment members having various numbers of positioning surfaces may be utilized without exceeding the scope of this invention.

Figure 11:
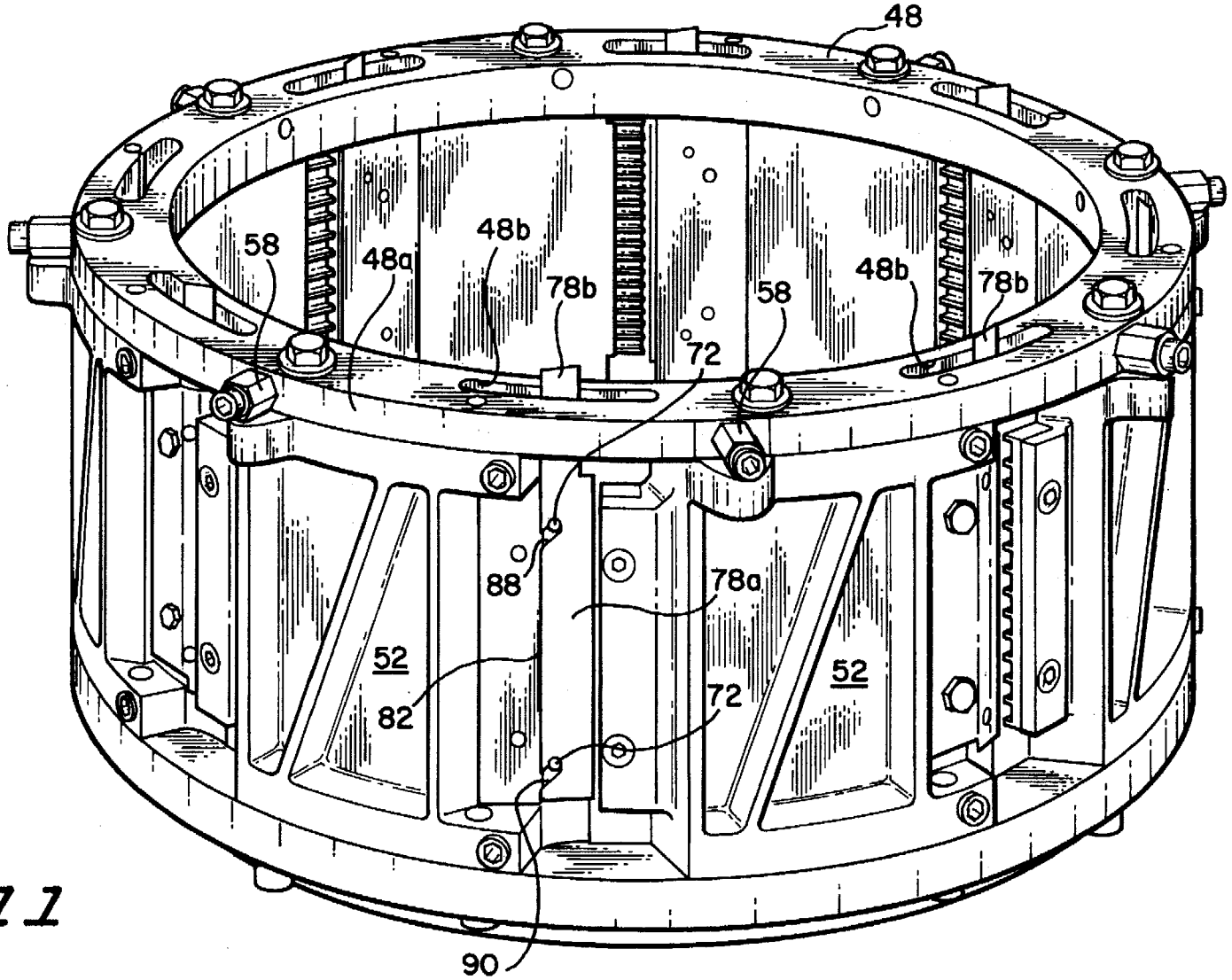
FIG. 11 is a perspective view of the cutting head according to the present invention with the clamping members removed illustrating the blade attaching mechanism.
Figures 12, 13A, 13B, 13C, 13D, 13E:
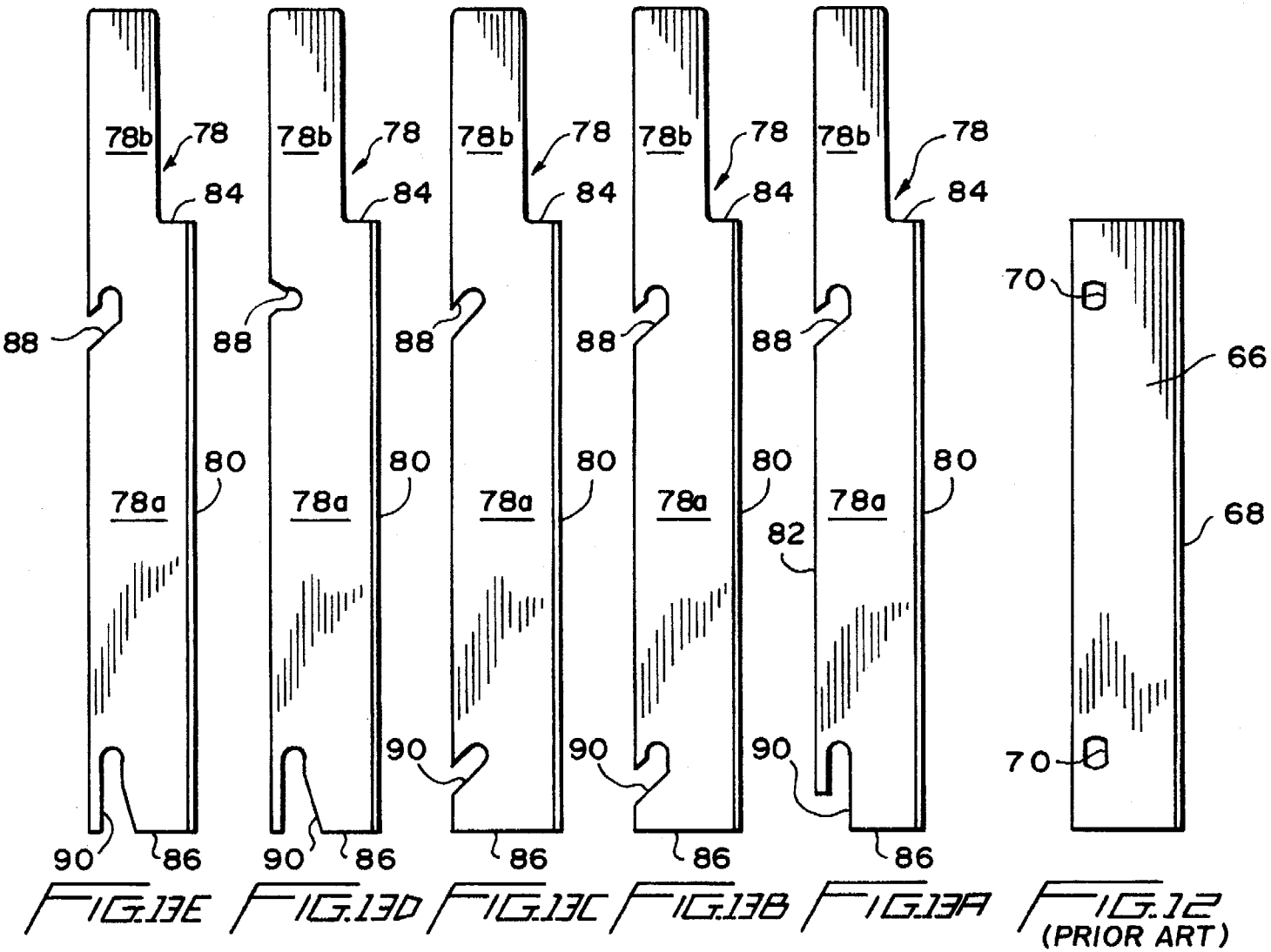
FIG. 12 (PRIOR ART)
FIG. 12 is a side view of a known cutting blade.
FIGS. 13A–13E are side views illustrating various configurations of the cutting blade according to the present invention.

The known cutting blade 66 is illustrated in FIG. 12 and typically has a cutting edge 68 formed thereon and defines openings 70 which are configured to engage blade locating pins extending from each cutter support segment. The blade locating pins are illustrated at 72 in FIG. 11. To attach the blade 66 to a cutter support segment, the blade 66 is placed such that blade locating pins 72 extend through openings 70 and a clamping member is attached to the cutter support segment via bolts such that the blade 66 is clamped to the cutter support segment. In order to change the known blades, it is necessary to loosen both bolts, reposition the clamping member such that enlarged portions of keyhole-shaped openings are aligned with the bolt heads and remove the clamping member such that the blade 66 can be removed from locating pins 72. Obviously, the attachment of a new blade is accomplished by the reverse steps.

The cutting head according to the present invention includes an improved cutting blade so as to more readily facilitate the removal and attachment of the blades from and to the cutter support segments. As best seen in FIGS. 11 and 13A–13E, the cutting blade 78 comprises a body portion 78*a* having a cutting edge 80, a rear edge 82 and opposite side edges 84 and 86. The new cutting blade also has a handle portion 78*b* which extends from a side edge, in this particular instance side edge 84, of the body portion 78*a*. The body portion 78*a* defines a plurality of notches 88*a*–88*e* and 90*a*–90*e* such that at least one of the notches, in this particular instance notch 88*a*–88*e*, open through the rear edge 82.

As best seen in FIG. 11, the upper mounting ring 48 defines a plurality of slots 48*b* located above the locations of each of the cutting blades 78 with the handle portion 78*b* of each blade extending through the slot 48*b* such that a portion extends above the upper mounting ring 48. In order to remove a blade attached to a cutter support segment 52, it is merely necessary to loosen the bolts 76 which thereby loosens the clamp member 74, grasp the handle portion 78*b* extending above the upper mounting ring 48 and pull the cutting blade 78 upwardly in a direction generally perpendicular to the plane of the upper mounting ring 48. This disengages the notches 88*a*–88*e* and 90*a*–90*e* from locating pins 72, thereby enabling the blade 78 to be pulled upwardly through the slot 48*b*. Attachment of a new blade 78 is achieved by merely passing the blade downwardly through a slot 48*b* while urging the rear edge 82 against the locating pins 72 until the pins slide into their respective notches 88*a*–88*e* and 90*a*–90*e*. The blade 78 is clamped in position by merely tightening clamping bolts 76. Although blade 78 is illustrated as having various configurations of two notches, it is to be understood that more or less than this number may be utilized without exceeding the scope of this invention.

The foregoing description is provided for illustrative purposes only and should not be construed as in any way limiting this invention, the scope of which is defined solely by the appended claims.

We claim:

1. A cutting head for slicing a food product on a slicing apparatus having a cutting head support ring, comprising:

a) a first annular mounting ring;

b) a plurality of cutter support segments disposed in a generally circular array, each cutter support segment having a top attached to the first annular mounting ring, a forward edge portion, a rear edge portion and a bottom;

c) a second annular mounting ring attached to the bottom of each cutter support segment and configured so as to engage the cutting head support ring so as to support and position the cutter support segments thereon;

d) a cutting blade attached to the forward edge portion of each cutter support segment so as to define a slicing opening between the cutting blade of the cutter support segment and the rear edge portion of an adjacent cutter support segment, the slicing opening determining the thickness of a food product slice; and, e) a plurality of slots through the first annular mounting ring, each slot positioned adjacent to a forward edge portion of a cutter support segment to enable passage of a cutting blade through the first annular mounting ring.

2. The cutting head of claim 1 further comprising attachment means to removably attach the cutting blade to the forward edge portion of the cutter support segment.

3. The cutting head of claim 2 wherein each cutting blade defines a forward cutting edge and a rear, opposite edge and wherein the attachment means comprises:

a) at least one locating pin extending from each cutter support segment;

b) at least one notch defined by each cutting blade, the at least one notch opening through the rear, opposite edge so as to engage the at least one locating pin when the cutting blade is moved in a direction generally perpendicular to a plane of the first annular mounting ring; and, c) a clamping member attached to the cutter support segment so as to clamp the cutting blade to the cutter support segment.

4. The cutting head of claim 2 wherein each cutting blade has a forward cutting edge and a rear, opposite edge, and wherein the attachment means comprises:

a) a plurality of locating pins extending from each cutter support segment; and, b) a plurality of notches defined by each cutting blade, the number of notches on each cutting blade being equal to the number of locating pins on each cutter support segment such that each notch engages a locating pin when the cutting blade is moved in a direction generally perpendicular to a plane of the first annular cutting ring; and, c) a clamping member attached to the cutter support segment so as to clamp the cutting blade to the cutter support segment.

5. The cutting head of claim 2 further comprising:

a handle portion extending from each cutting blade so as to extend through one of the plurality of slots in the first annular mounting ring.

6. A cutting blade configured so as to be removably attached to a cutting head apparatus, the cutting blade comprising:

a) a body portion having a cutting edge, a rear edge opposite the cutting edge and first and second generally parallel opposite side edges;

b) a handle portion extending from the first side edge of the body portion; and, c) a plurality of openings extending through the body portion and located between the first and second opposite side edges wherein at least one of the openings comprises a notch opening through the rear edge.

7. The cutting blade of claim 6 wherein the handle portion is substantially planar in configuration.

8. The cutting blade of claim 7 wherein the body portion is substantially planar in configuration and is substantially co-planar with the handle portion.

9. The cutting blade of claim 6 wherein the cutting edge extends between the opposite side edges of the body portion.

10. The cutting blade of claim 6 wherein at least one of the openings comprises a notch opening through the second side edge.

11. A cutting head for slicing a food product on a slicing apparatus having a cutting head support ring, comprising:

a) an annular mounting ring;

b) a plurality of cutter support segments disposed in a generally circular array, each cutter support segment having a top attached to the annular mounting ring, a forward edge portion, a rear edge portion and a bottom;

e) a cutting blade attached to the forward edge portion of each cutter support segment so as to define a slicing opening between the cutting blade of one cutter support segment and the rear edge portion of an adjacent cutter support segment, the slicing opening determining the thickness of a food product slice wherein each cutting blade has a forward cutting edge and a rear, opposite edge;

d) attachment means to attach the cutting blade to the forward edge portion of the cutter support segment comprising:

i) at least one locating pin extending from each cutter support segment;

ii) at least one notch defined by the cutting blade, the at least one notch opening through the rear, opposite edge so as to engage the at least one locating pin; and, iii) a clamping member attached to the cutter support segment so as to clamp the cutting blade to the cutter support segment: and, a plurality of slots through the annular mounting ring, each slot positioned adjacent to a forward edge portion of a cutter support segment to enable passage of a cutting blade through the annular mounting ring.

12. The cutting head of claim 11 wherein the at least one locating pin comprises a plurality of locating pins extending from each cutter support segment and wherein the at least one notch comprises a plurality of notches, the number of notches on each cutting blade being equal to the number of locating pins on each cutter support segment.

13. The cutting head of claim 11 further comprising:

a handle portion extending from each cutting blade so as to extend through one of the plurality of slots through the annular mounting ring.

14. A cutting head for slicing a food product on a slicing apparatus having a cutting head support ring, comprising:

a) an annular mounting ring;

b) a plurality of cutter support segments disposed in a generally circular array, each cutter support segment having a top attached to the annular mounting ring, a forward edge portion, a rear edge portion and a bottom;

c) a cutting blade attached to the forward edge portion of each cutter support segment so as to define a slicing opening between the cutting blade of one cutter support segment and the rear edge portion of an adjacent cutter support segment, the slicing opening determining the thickness of a food product slice wherein each cutting blade has a forward cutting edge and a rear, opposite edge; and, d) a plurality of slots through the annular mounting ring, each slot positioned adjacent to a forward edge portion of a cutter support segment to enable passage of a cutting blade through the annular mounting ring.

15. The cutting head of claim 14 further comprising: a handle portion extending from each cutting blade so as to extend through one of the plurality of slots through the annular mounting ring.

* * * * *